US007008303B2

(12) United States Patent
White et al.

(10) Patent No.: US 7,008,303 B2
(45) Date of Patent: Mar. 7, 2006

(54) WEB LIFT SYSTEM FOR CHEMICAL MECHANICAL PLANARIZATION

(75) Inventors: John M. White, Hayward, CA (US); Phillip R. Sommer, Newark, CA (US); Sasson Somekh, Los Altos Hills, CA (US)

(73) Assignee: Applied Materials Inc., Santa Clara, CA (US)

( * ) Notice: Subject to any disclaimer, the term of this patent is extended or adjusted under 35 U.S.C. 154(b) by 123 days.

(21) Appl. No.: 10/408,032

(22) Filed: Apr. 3, 2003

(65) Prior Publication Data

US 2003/0171069 A1 Sep. 11, 2003

Related U.S. Application Data

(63) Continuation of application No. 09/651,657, filed on Aug. 29, 2000, now Pat. No. 6,561,884.

(51) Int. Cl.
*B24B 1/00* (2006.01)
*B24B 7/00* (2006.01)

(52) U.S. Cl. ..... 451/59; 451/41; 451/297; 451/311

(58) Field of Classification Search ..... 451/296, 451/297, 303, 305, 306, 307, 308, 310, 311, 451/36, 41, 59, 63
See application file for complete search history.

(56) References Cited

U.S. PATENT DOCUMENTS

| | | | |
|---|---|---|---|
| 3,376,578 A | 4/1968 | Sawyer | |
| 3,929,551 A | 12/1975 | Frantzen | 156/345 |
| 4,347,689 A | 9/1982 | Hammond | |
| 4,373,991 A | 2/1983 | Banks | 156/645 |
| 4,521,995 A | 6/1985 | Sekiya | 451/388 |
| 4,571,799 A | 2/1986 | Chitayat | |
| 4,603,867 A | 8/1986 | Babb et al. | 279/3 |
| 4,642,943 A | 2/1987 | Taylor, Jr. | |
| 5,036,630 A | 8/1991 | Kaanta et al. | |
| 5,065,547 A | 11/1991 | Shimizu et al. | |
| 5,076,024 A | 12/1991 | Akagawa et al. | |
| 5,088,240 A | 2/1992 | Ruble et al. | |
| 5,099,615 A | 3/1992 | Ruble et al. | |
| 5,209,027 A | 5/1993 | Ishida et al. | |
| 5,276,999 A | 1/1994 | Bando | |

(Continued)

FOREIGN PATENT DOCUMENTS

EP 0756917 A1 2/1997

(Continued)

OTHER PUBLICATIONS

Sommer, et al., "Polishing Media Stabilizer", U.S. Appl. No. 09/258,036, filed Feb. 25, 1999.

(Continued)

*Primary Examiner*—Timothy V. Eley
(74) *Attorney, Agent, or Firm*—Patterson & Sheridan

(57) ABSTRACT

Generally, a method and system for lifting a web of polishing material is provided. In one embodiment, the system includes a platen that has a first lift member disposed adjacent to a first side and a second lift member disposed adjacent to a second side. The platen is adapted to support the web of polishing media that is disposed between the first and the second lift members. A method includes supporting a web of polishing media on a platen between a first lift member and a second lift member and moving at least the first lift member or the second lift member to an extended position relative the platen that places the web in a spaced-apart relation with the platen.

15 Claims, 5 Drawing Sheets

U.S. PATENT DOCUMENTS

| | | | | |
|---|---|---|---|---|
| 5,377,451 | A | 1/1995 | Leoni et al. | 451/287 |
| 5,399,125 | A | 3/1995 | Dozier | 474/117 |
| 5,423,716 | A | 6/1995 | Strasbaugh | 451/388 |
| 5,476,413 | A | 12/1995 | Hasegawa et al. | 451/168 |
| 5,486,129 | A | 1/1996 | Sandhu et al. | 451/5 |
| 5,490,808 | A | 2/1996 | Jantschek et al. | 451/59 |
| 5,531,861 | A | 7/1996 | Yu et al. | 156/636.1 |
| 5,536,202 | A | 7/1996 | Appel et al. | 451/285 |
| 5,558,568 | A | 9/1996 | Talieh et al. | 451/303 |
| 5,593,344 | A | 1/1997 | Weldon et al. | 451/296 |
| 5,624,299 | A | 4/1997 | Shendon | 451/28 |
| 5,635,083 | A | 6/1997 | Breivogel et al. | 216/88 |
| 5,722,877 | A | 3/1998 | Meyer et al. | 451/41 |
| 6,062,959 | A | 5/2000 | Weldon et al. | 451/307 |
| 6,135,859 | A | 10/2000 | Tietz | 451/41 |
| 6,241,585 | B1 | 6/2001 | White | 451/41 |
| 6,244,944 | B1 | 6/2001 | Elledge | 451/296 |
| 6,273,796 | B1 * | 8/2001 | Moore | 451/56 |
| 6,273,800 | B1 | 8/2001 | Walker et al. | 451/168 |
| 6,361,417 | B1 * | 3/2002 | Walker et al. | 451/168 |

FOREIGN PATENT DOCUMENTS

| | | | |
|---|---|---|---|
| EP | 0774323 | A3 | 10/1997 |
| EP | 0818272 | A1 | 1/1998 |
| EP | 1052063 | A1 | 11/2000 |
| JP | 62-162466 | | 7/1987 |
| JP | 2-269553 | | 11/1990 |
| JP | 402269553 | A | 11/1990 |
| JP | 03028371 | | 2/1991 |
| JP | 4-53682 | | 2/1992 |
| JP | 4-250967 | | 9/1992 |
| JP | 7-111256 | | 4/1996 |
| JP | 9-225821 | | 2/1997 |
| JP | 02000353679 | A | 12/2000 |
| JP | 02001071250 | A | 3/2001 |

OTHER PUBLICATIONS

Butterfield, et al., "Platen With Web Release Apparatus", U.S. Appl. No. 09/676,395, filed Sep. 29, 2000.

Li, et al., "Platen for Retaining Polishing Material", U.S. Appl. No. 09/709,769, filed Nov. 10, 2000.

Franklin, et al., "Integrated Platen Assembly for a Chemical Mechanical Planarization System", U.S. Appl. No. 09/931,156, filed Aug. 16, 2001.

White, et al., "Web Lift System for Chemical Mechanical Planarization", U.S. Appl. No. 09/651,657, filed Aug. 29, 2000.

* cited by examiner

WEB LIFT SYSTEM FOR CHEMICAL MECHANICAL PLANARIZATION

CROSS-REFERENCE TO RELATED APPLICATIONS

This application is a continuation application of U.S. patent application Ser. No. 09/651,657, filed Aug. 29, 2000, now U.S. Pat. No. 6,561,884 which is hereby incorporated by reference in its entirety.

BACKGROUND OF THE DISCLOSURE

1. Field of Invention

Embodiments of the present invention relate generally to a web lift system and a method for lifting a web in a polishing system.

2. Background of Invention

In semiconductor wafer processing, the use of chemical mechanical planarization, or CMP, has gained favor due to the enhanced ability to increase device density on a semiconductor workpiece, or substrate, such as a wafer. As the demand for planarization of layers formed on wafers in semiconductor fabrication increases, the requirement for greater system (i.e., process tool) throughput with less wafer damage and enhanced wafer planarization has also increased.

An exemplary CMP system that addresses these issues is described in U.S. patent application Ser. No. 09/244,456, filed Feb. 4, 1999 to Birang et al., which is incorporated by reference in its entirety. Birang et al. disclose a CMP system having a planarization system that is supplied wafers from cassettes located in an adjacent liquid filled bath. A transfer mechanism, or robot, facilitates the transfer of the wafers from the bath to a transfer station. The transfer station generally contains a load cup that positions wafers into one of four processing heads mounted to a carousel. The carousel moves each processing head sequentially over the load cup to receive a wafer. As the processing heads are loaded, the carousel moves the processing heads and wafers through the planarization stations for polishing. The wafers are planarized by moving the wafer relative to a polishing material in the presence of a slurry or other polishing fluid medium. The polishing material may include an abrasive surface. The slurry typically contains both chemicals and abrasives that aid in the removal of material from the wafer. After completion of the planarization process, the wafer is returned back through the transfer station to the proper cassette located in the bath.

Conventional polishing pads are generally comprised of a foamed polymer having a textured or porous surface. The textured or porous surface functions to retain the polishing fluid that normally contains abrasive slurry on the polishing pad during the polishing operation. The abrasives in slurry provide the mechanical component of the planarization process planarizes (i.e., polishes) the substrate in concert with chemical agents present in the polishing fluid.

One type of polishing material that may be utilized for chemical mechanical polishing is known as a fixed abrasive material. The fixed abrasive material comprises a plurality of abrasive particles suspended in a resin binder that is disposed in discrete elements on a backing sheet. As the abrasive particles are contained in the polishing material itself, systems utilizing fixed abrasive material generally use polishing fluid that do not contain abrasives. Such polishing fluids enhance the service life of their fluid delivery systems.

Both conventional and fixed abrasive polishing material are generally available in stick-down form or in the form of a web. Generally, conventional polishing material may loose ability to adequately retain polishing fluid over the course of polishing a number of substrates as the polishing surface of the material is consumed by the polishing process.

Fixed abrasive material is typically used in web form. Generally, the polishing process wears down the abrasive elements disposed on the web. To maintain a polishing surface that produces uniform polishing results, the web is periodically indexed to remove portions of the web that may have become worn, replacing those portions with an unused portion of the web.

However, indexing the web across a polishing platen is sometimes difficult. The polishing and other fluids that come in contact with the web may cause surface tension or attraction to develop between the web and the underlying surface of the platen. This surface tension must be overcome to accomplish advancement of the web. If the attraction between the web and platen is great, the indexing means may not be able to index the web or the web may become damaged during the indexing process.

Providing a cushion of gas between the web and platen assists in overcoming the attraction between the web and platen. The gas lifts the web to a spaced-apart relation to the platen where the web may be freely indexed. However, providing gas to the area between the web and platen is complicated, and requires rotary union and process tubing to be routed through an already crowded platen.

Therefore, there is a need for a system that lifts a web of polishing material from a platen so that the web may be freely moved across the platen.

SUMMARY OF INVENTION

One aspect of the present invention generally provides a system for lifting a web of polishing material. In one embodiment, the system includes a platen that has a first lift member disposed adjacent a first side and a second lift member disposed adjacent a second side. The platen is adapted to support the web of polishing media that is disposed between the first and the second lift members. At least one of the lift members has a retracted and an extended position, the extended position adapted to place the web in a spaced-apart relation with the platen. In another embodiment, the system further comprises a web of polishing material and a polishing head adapted to retain the substrate while moving the substrate relative to the web in a polishing pattern.

In another aspect of the invention, a method for lifting a web of polishing material is provided. In one embodiment, the method includes the steps of supporting a web of polishing media on a platen between a first lift member and a second lift member and moving at least one of the first lift member or the second lift member to an extended position relative the platen that places the web in a spaced-apart relation with the platen.

BRIEF DESCRIPTION OF DRAWINGS

The teachings of the present invention can be readily understood by considering the following detailed description in conjunction with the accompanying drawings, in which.

To facilitate understanding, identical reference numerals have been used, where possible, to designate identical elements that are common to the figures.

DETAILED DESCRIPTION OF INVENTION

Figure 1:
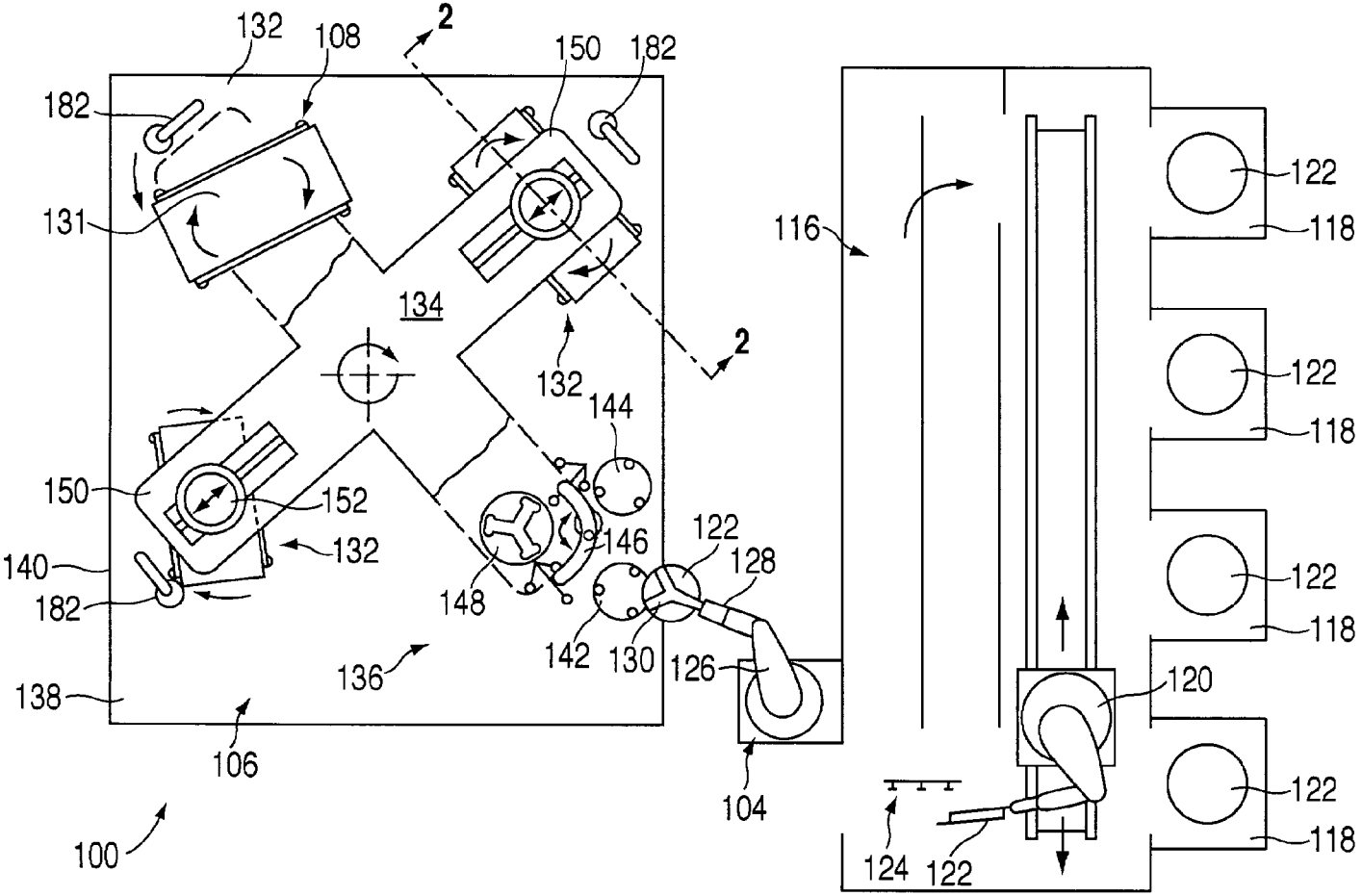
FIG. 1 is a plan view of one embodiment of a chemical mechanical planarization system of the invention.
Figure 2:
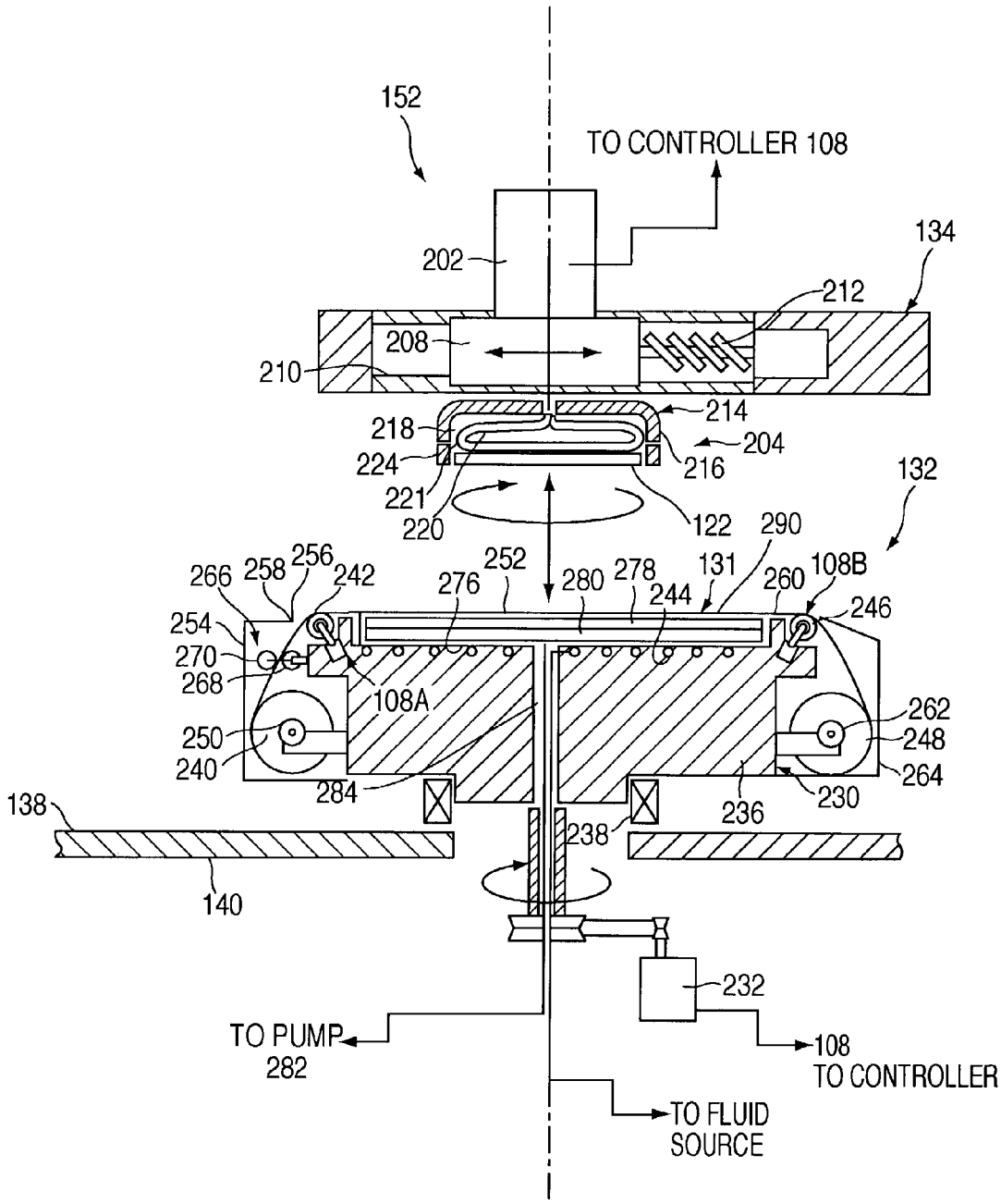
FIG. 2 is a sectional view of a polishing station taken along section line 2—2 of FIG. 1.

FIG. 1 depicts a plan view of one embodiment of a chemical mechanical planarization system 100 having one or more lift assemblies 108 (shown as two lift assemblies 108A and 108B in the embodiment depicted in FIG. 2). The exemplary system 100 generally comprises a factory interface 102, a loading robot 104, and a polishing module 106. Generally, the loading robot 104 is disposed proximate the factory interface 102 and the polishing module 106 to facilitate the transfer of substrates 122 therebetween.

The factory interface 102 generally includes a cleaning module 116 and one or more wafer cassettes 118. An interface robot 120 is employed to transfer substrates 122 between the wafer cassettes 118, the cleaning module 116 and an input module 124. The input module 124 is positioned to facilitate transfer of substrates 122 between the polishing module 106 and the factory interface 102 by the loading robot 104. For example, unpolished substrates 122 retrieved from the cassettes 118 by the interface robot 120 may be transferred to the input module 124 where the substrates 122 may be accessed by the loading robot 104 while polished substrates 122 returning from the polishing module 106 may be placed in the input module 124 by the loading robot 104. Polished substrates 122 are typically passed from the input module 124 through the cleaning module 116 before the factory interface robot 120 returns the cleaned substrates 122 to the cassettes 118. An example of such a factory interface 102 that may be used to advantage is disclosed in U.S. patent application Ser. No. 09/547,189, filed Apr. 11, 2000, which is hereby incorporated by reference.

The loading robot 104 is generally positioned proximate the factory interface 102 and the polishing module 106 such that the range of motion provided by the robot 104 facilitates transfer of the substrates 122 therebetween. An example of a loading robot 104 is a 4-Link robot, manufactured by Kensington Laboratories, Inc., located in Richmond, Calif.

The exemplary loading robot 104 has an articulated arm 126 having a rotary actuator 128 at its distal end. An edge contact gripper 130 is coupled to the rotary actuator 128. The rotary actuator 128 permits the substrate 122 secured by the gripper 130 to be orientated in either a vertical or a horizontal orientation without contacting the feature side 120 of the substrate 122 and possibly causing scratching or damage to the exposed features. Additionally, the edge contact gripper 130 securely holds the substrate 122 during transfer, thus decreasing the probability that the substrate 122 will become disengaged. Optionally, other types of grippers, such as electrostatic grippers, vacuum grippers and mechanical clamps, may be substituted.

One polishing module 106 that can be used to advantage with the present invention is a Mirra® Chemical Mechanical Polisher, manufactured by Applied Materials, Inc., located in Santa Clara, Calif. Other polishing modules 102 including those that use polishing pads, polishing webs, or a combination thereof may also be used to advantage. Other systems that benefit include systems that move a substrate relative a polishing surface in a rotational, linearly or in other motion within a plane.

The exemplary polishing module 106 has a transfer station 136, a plurality of polishing stations 132 and a carousel 134 disposed on an upper or first side 138 of a machine base 140. In one embodiment, the transfer station 136 comprises at least an input buffer station 142, an output buffer station 144, a transfer robot 146, and a load cup assembly 148. The loading robot 104 places the substrate 122 onto the input buffer station 142. The transfer robot 146 has two gripper assemblies, each having pneumatic gripper fingers that grab the substrate 122 by the substrate's edge. The transfer robot 146 lifts the substrate 122 from the input buffer station 142 and rotates the gripper and substrate 122 to position the substrate 122 over the load cup assembly 148, then places the substrate 122 down onto the load cup assembly 148. An example of a transfer station that may be used to advantage is described by Tobin in U.S. patent application Ser. No. 09/314,771, filed Oct. 6, 1999, which is hereby incorporated by reference.

The carousel 134 is generally described by Tolles in the previously incorporated U.S. Pat. No. 5,804,507. Generally, the carousel 134 is centrally disposed on the base 140. The carousel 134 typically includes a plurality of arms 150, each supporting a polishing head assembly 152. Two of the arms 150 depicted in FIG. 1 are shown in phantom such that a polishing surface 131 of one of the polishing stations 132 and the transfer station 136 may be seen. The carousel 134 is indexable such that the polishing head assemblies 152 may be moved between the polishing stations 132 and the transfer station 136.

Generally, a chemical mechanical polishing process is performed at each polishing station 132.

A conditioning device 182 is disposed on the base 140 adjacent each polishing station 132. The conditioning device 182 periodically conditions the polishing surface 131 to maintain uniform polishing results.

FIG. 2 depicts a sectional view of the polishing head assembly 152 supported above the polishing station 132. The polishing head assembly 152 generally comprises a drive system 202 coupled to a polishing head 204. The drive system 202 generally provides rotational motion to the polishing head 204. The polishing head 204 additionally may be actuated to extend towards the polishing station 132 such that the substrate 122 retained in the polishing head 204 may be disposed on the polishing station 132.

The drive system 202 is coupled to a carrier 208 that translates upon a rail 210 disposed in the arm 150 of the carousel 134. A ball screw or other linear motion device 212 couples the carrier 208 to the carousel 134 and positions the drive system 202 and polishing head 204 along the rail 210.

In one embodiment, the polishing head 204 is a TITAN HEAD™ wafer carrier manufactured by Applied Materials, Inc., Santa Clara, Calif. Generally, the polishing head 204 comprises a housing 214 having an extending lip 216 that defines a center recess 218 in which is disposed a bladder 220. The bladder 220 may be comprised of an elastomeric material or thermoplastic elastomer such as ethylene propylene, silicone and HYTREL™. The bladder 220 is coupled to a fluid source (not shown) such that the bladder 220 may be controllably inflated or deflated. The bladder 220, when in contact with the substrate 122, retains the substrate 122 within the polishing head 204 by deflating, thus creating a vacuum between the substrate 122 and the bladder 220. A retaining ring 224 circumscribes the polishing head 204 to retain the substrate 122 within the polishing head 204 while polishing.

Disposed between the polishing head assembly 154 and the polishing station 132 is a web of polishing material 252. The web of polishing material 252 may have a smooth surface, a textured surface, a surface containing a fixed abrasive or a combination thereof. The web of polishing material 252 may be in the form of a roll or sheet (e.g., pad) of material that may be advanced across or releasably fixed to the polishing surface. Typically, the web of polishing material 252 is releasably fixed by adhesives, vacuum, mechanical clamps or by other holding methods to the platen 230.

The web of polishing material 252 may include fixed abrasives. Fixed abrasive typically comprises a plurality of abrasive particles suspending in a resin binder that is disposed in discrete elements on a backing sheet. Examples of such fixed abrasive pads are described in U.S. Pat. No. 5,692,950, by Rutherford et al. (issued Dec. 2, 1997) and U.S. Pat. No. 5,453,312, by Haas et al. (issued Sep. 26, 1995), both of which are hereby incorporated by reference.

The web of polishing material 252 may optionally comprise conventional polishing material without fixed abrasives. Conventional polishing material is generally comprised of polyurethane. Conventional polishing material typically uses polishing fluids that includes entrained abrasives. Subpads used with conventional material are generally lower in hardness (i.e., softer) than the subpads typically used with fixed abrasive webs 252. Conventional material (i.e., pads without fixed abrasives) is available from Rodel, Inc., of Newark, Del.

The polishing station 132 generally comprises a platen 230 that is disposed on the base 140. The platen 230 is typically comprised of aluminum. The platen 230 is supported above the base 140 by a bearing 238 so that the platen 230 may rotate in relation to the base 140. An area of the base 140 circumscribed by the bearing 238 is open and provides a conduit for the electrical, mechanical, pneumatic, control signals and connections communicating with the platen 230.

Conventional bearings, rotary unions and slip rings (not shown) are provided such that electrical, mechanical, pneumatic, control signals and connections may be coupled between the base 140 and the rotating platen 230. The platen 230 is typically coupled to a motor 232 that provides the rotational motion to the platen 230.

The platen 230 has an upper portion 236 that supports the web of polishing material 252. A top surface 260 of the platen 230 contains a center recess 276 extending into the top portion 236. The top portion 236 may optionally include a plurality of passages 244 disposed adjacent to the recess 276. The passages 244 are coupled to a fluid source (not shown). Fluid flowing through the passages 244 may be used to control the temperature of the platen 230 and the polishing material 252 disposed thereon.

A subpad 278 and a subplate 280 are disposed in the center recess 276. The subpad 278 is typically a plastic, such as polycarbonate or foamed polyurethane. Generally, the hardness or durometer of the subpad may be chosen to produce a particular polishing result. The subpad 278 generally maintains the polishing material 252 parallel to the plane of the substrate 122 held in the polishing head 204 and promotes global planarization of the substrate 122. The subplate 280 is positioned between the subpad 278 and the bottom of the recess 276 such that the upper surface of the subpad 278 is coplanar with the top surface 260 of the platen 230.

Both the subpad 278 and the subplate 280 optionally contain a plurality of apertures (not shown) that are generally disposed in a pattern such that the polishing motion of the substrate 122 does not cause a discrete portion of the substrate 122 to pass repeatedly over the apertures while polishing as compared to the other portions of the substrate 122. A vacuum port 284 is provided in the recess 276 and is coupled to an external pump 282. When a vacuum is drawn through the vacuum port 284, the air removed between the polishing material 252 and the subpad 278 causes the polishing material 252 to be firmly secured to the subpad 278 during polishing. An example of such polishing material retention system is disclosed in U.S. patent application Ser. No. 09/258,036, filed Feb. 25, 1999, by Sommer et al., which is hereby incorporated by reference. The reader should note that other types of devices may be utilized to fix the polishing material 252 to the platen 230, for example adhesives, bonding, electrostatic chucks, mechanical clamps and other retention mechanisms.

Optionally, to assist in releasing the polishing material 252 from the subpad 278 and platen 230 prior to advancing the polishing material 252, surface tension caused by fluid that may be disposed between the subpad 278 and the polishing material 252, a blast of gas (e.g., air) may be provided through the vacuum port 284 or other port (not shown) into the recess 276 by the pump 282 (or other pump). The air pressure within the recess 276 moves through the apertures (not shown) disposed in the subpad 278 and subplate 280 and lifts the polishing material 252 from the subpad 278 and the top surface 260 of the platen 230. The polishing material 252 rides upon the cushion of air such that it may be freely indexed across the platen 230. Alternatively, the subpad 278 may be a porous material that permits gas (e.g., air) to permeate therethrough and lift the polishing material 252 from the platen 230. Such a method for releasing the web 252 is described in U.S. patent application No. 60/157,303, filed Oct. 1, 1999, by Butterfield, et al., and is hereby incorporated by reference in its entirety.

Mounted to one side of the platen 230 is a supply roll 240. The supply roll 240 generally contains a portion of the web of polishing media 252 wound thereon. The web of polishing media 252 is fed over a lift member 242 of the lift assembly 108A and across the top surface 260 of the platen. The web of polishing media 252 is fed over a lift member 246 of the lift assembly 108B and to a take-up roll 248 disposed to the other side of the platen 230. The lift members 242, 246 may be a roller, a rod, a bar or other member configured to allow the web 252 to move thereover with minimal damage to the web, particulate generation or contamination of the web.

The supply roll 240 is removably coupled to the platen 230 to facilitate loading another unwind roll containing unused polishing media once the web of polishing media 252 is consumed over the course of polishing a number of substrates. The supply roll 240 is coupled to a slip clutch 250 or similar device that prevents the web of polishing media 252 from inadvertently unwinding from the supply roll 240.

The supply roll 240 is covered by a housing 254 that protects the supply roll 240 from damage and contamination. To further prevent contamination of the supply roll 240, a gas is disposed in the volume between the housing 254 and the platen 230 which flows out a gap 256 defined between an edge 258 of the housing 254 and the web of polishing media 252 disposed on the lift member 242. The gas flowing through the gap 256 prevents contaminants such as polishing fluids and byproducts from coming in contact with the unused portion of the web of polishing media 252 disposed on the supply roll 240 enclosed by the housing 254.

The take-up roll 248 generally is removably coupled to the platen 230 to facilitate removal of used polishing media that is wound thereon. The take-up roll 248 is coupled to a tensioning device 262 that keeps the web of polishing media 252 keeps taunt between the supply roll 240 and take-up roll 248. A housing 264 is disposed over the take-up roll 248 protects the take-up roll 248 from damage and contamination.

The web of polishing media 252 is advanced between the supply roll 240 and take-up roll 248 by an indexing means 266. In one embodiment, the indexing means 266 comprises a drive roller 268 and an idler 270 that pinches the web of polishing media 252 therebetween. The drive roller 256 generally is coupled the platen 230. The drive roller 256 is connected to a controlled motor such as a stepper and an encoder (motor and encoder not shown). The indexing means 266 enables a predetermined length of polishing to be pulled off the supply roll 240 by drive roller 256 as the drive roller 256 is controllably rotated. A corresponding length of polishing is wound on the take-up roll 248 as the web of polishing media 252 is advanced across the platen 230.

Before the web of polishing media 252 is advanced across the platen 230, at least one of the lift assemblies 108A or 108B is raised to an extended position to maintain the web of polishing media 252 in a spaced-apart relation to the platen 230. In a spaced-apart relation, the web 252 may be freely advanced without having to overcome surface tension due to fluid disposed between the web and the platen or possibly creating particulate by contacting the backside of the web with the platen while the web is moving.

Figure 3:
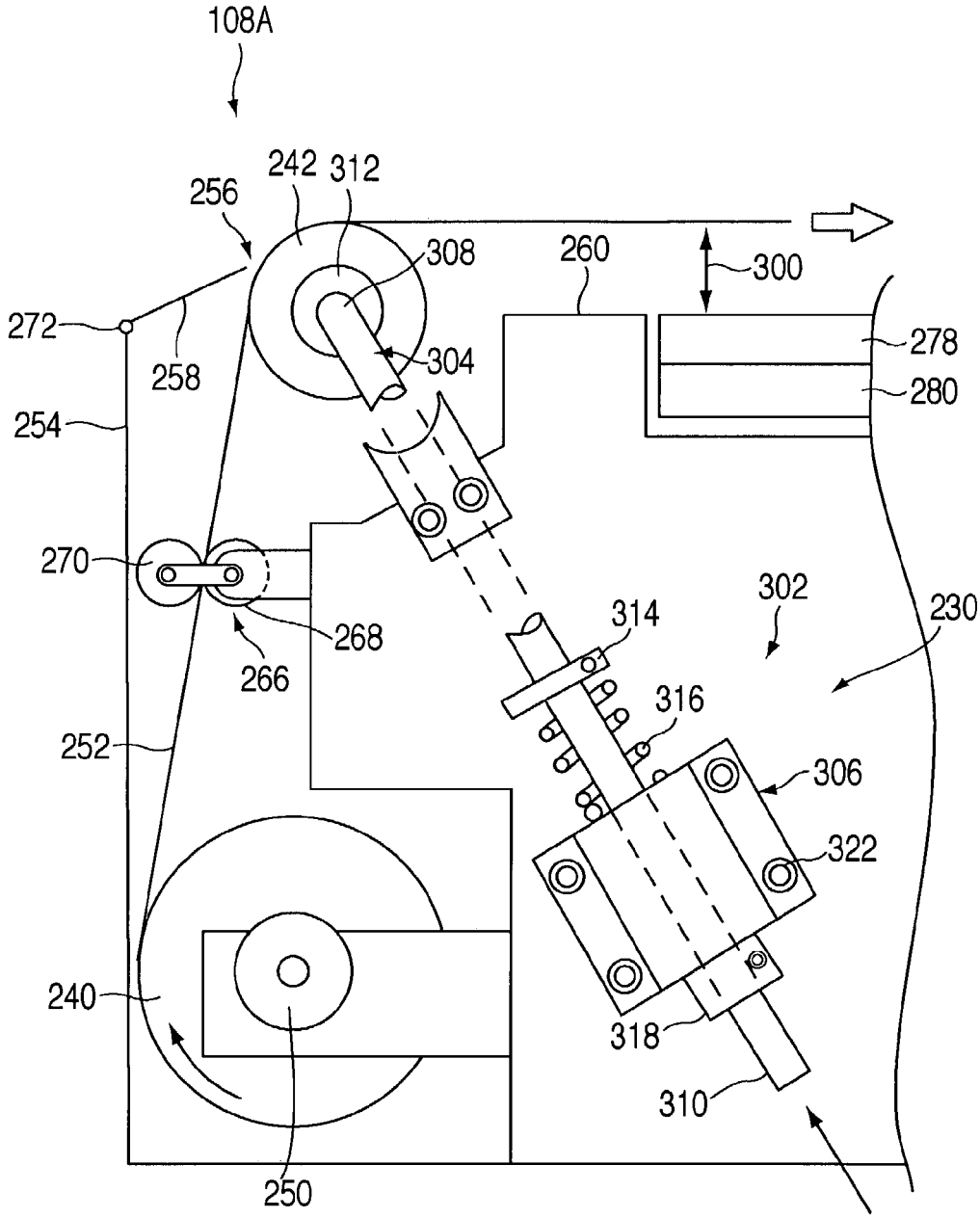
FIG. 3 is an elevation of one embodiment of a lift assembly in a raised position.

FIG. 3 depicts one embodiment of the platen 230 having the lift assembly 108A in the extended position. The lift assembly 108A is generally lifts the web of polishing material 252 into a spaced-apart relation with the top surface 260 of the platen 230 (and subpad 278) defining a gap 300. The lift assembly 108A generally includes the lift member 242 and a displacement means 302 for moving the lift member 242 between the extended position shown in FIG. 3 and a retracted position shown in FIGS. 2 and 4. The displacement means 302 may include gas pots, springs, linear actuators, pneumatic cylinders, hydraulic cylinders, ball screws, solenoids, and other motion control devices.

In one embodiment, the lift assembly 108A includes a rod 304 and bearing block 306. The rod 304 is slidably disposed in the bearing block 306 that is coupled to the platen 230 via a plurality of mounting screws 322. The block 306 may have solid, roller or ball bearings such as a pillow block.

The rod 304 has a first end 308 and a second end 310. The first end 308 of the rod 304 is coupled to the lift member 242. A bearing 312 may be disposed between the rod 304 and lift member 242 to enhance the rotation of the lift member 242 when in the extended position. Alternatively, the bearing 312 and lift member 242 may be replaced with a lift member or bar that lifts the web of polishing media 252. The bar should have a radius or chamfered edge to prevent damage to the web 252 as it is indexed across the bar.

A first collar 314 and a second collar 318 are disposed on the rod 304. The first collar 314 and second collar 318 may be secured in various positions along the length of the rod 304. In one embodiment, the collars 314 and 318 include a set screw to fix the collar in relation to the rod 304.

The first collar 314 is disposed between the first end 308 of the rod 304 and the block 306. The second collar 318 is disposed between the second end 310 of the rod 304 and the block 304. The first collar 314 captures a spring 316 between the first collar 314 and the block 306 while the second collar 318 may be positioned to limit the extension of the lift member 242 (and thus the length of the gap 300). The first collar 314 may be positioned along the rod 304 such that the first collar 314 determines the amount of compression on the spring 316 when lift assembly 108A is in the extended position.

The spring 316 may be any energy storage device that produces or can be activated to produce an upward force on the rod 304. Such devices include pneumatic cylinders, solenoids, hydraulic cylinders, compression springs, belleville washers, elastomers and the like. In one embodiment, the spring 316 comprises a coil spring. The spring 316 is selected to provide the force and travel needed to move the web 252 into the spaced-apart relation with the platen 230 when the slip-clutch 250 (and indexing means 266) feeds out a length of web 252 and to maintain the gap 300 while the web is advanced across the platen 230.

The housing 254 may include a hinge 272 that allowed the edge 258 to follow the movement of the lift assembly 108A while maintaining the gap 256 (i.e., to prevent the housing from contacting the web when the lift assembly 108A is in the extended position). The housing 264 may be similarly constructed.

Figure 4:
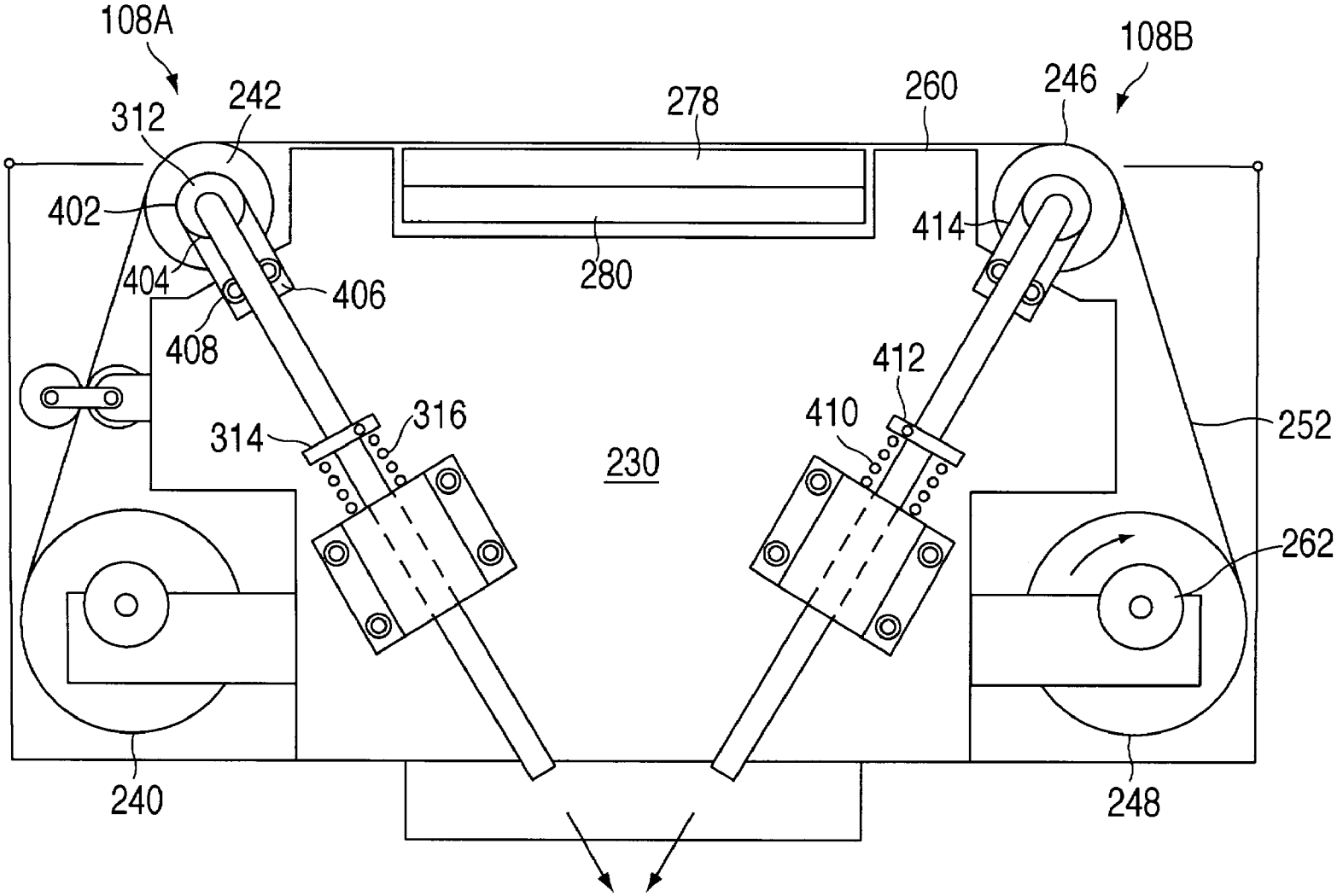
FIG. 4 is an elevation of one embodiment of a lift assembly in a lowered position.

FIG. 4 depicts the platen 230 having the lift assemblies 108A and 108B in the retracted position. When tension is applied to the web of polishing material 252 by the tensioning device 262, the spring 316 is compressed allowing the lift member 242 to be seated on a bracket 320 that is coupled to the plenum 230. In one embodiment, an outer surface 402 of the bearing 312 seats against a mating surface 404 of the bracket 406. Generally, the bracket 320 is coupled to the plenum 230 by fasteners 408, but optionally, the bracket 320 may be integrally incorporated into the plenum 230.

The tensioning of the web 252 also seats the lift member 246 of the second lift assembly 108B on a bracket 414. The second lift assembly 108B is substantially similar to the first lift assembly 108A described with reference to FIG. 3. The second lift assembly 108B generally has a greater bias force than the first lift assembly 108A that causes the second lift assembly 108B to unseat (i.e., extend) before and be seated after the first lift assembly 108A. The sequencing of the movement between the first and second lift assemblies 108A, 108B keeps the web of polishing material 252 from dragging across the platen 230 or subpad 278 when wound upon the take-up roll 248. Alternatively, the lift assemblies 108A, 108B may comprise substantially identical bias forces such that the lift assemblies 108A, 108B move substantially simultaneously.

To achieve the sequencing between the first and the second lift assemblies 108A, 108B, one embodiment of the second lift assembly 108A may include a spring 410 that provides a greater bias force that the spring 316 of the first lift assembly 108A. Alternatively, a collar 412 that retains the spring 410 to the second lift assembly 108B may be positioned to compress the spring 410 more than the spring 316, thereby generating a greater bias force in the second lift assembly 108B when the springs 316 and 410 are identical. Optionally, other methods of creating a difference in the bias forces between the springs may be utilized such as using different free lengths, wire diameters, spring materials, spring constants and the like.

In another embodiment where one lift assembly is utilized, the second lift assembly may be replaced by a roller or other device to guide the polishing media on top of the platen. For example, the second lift assembly 108B depicted in FIG. 4 may be replaced by fixing the member 246 to the platen 230.

Figure 5:
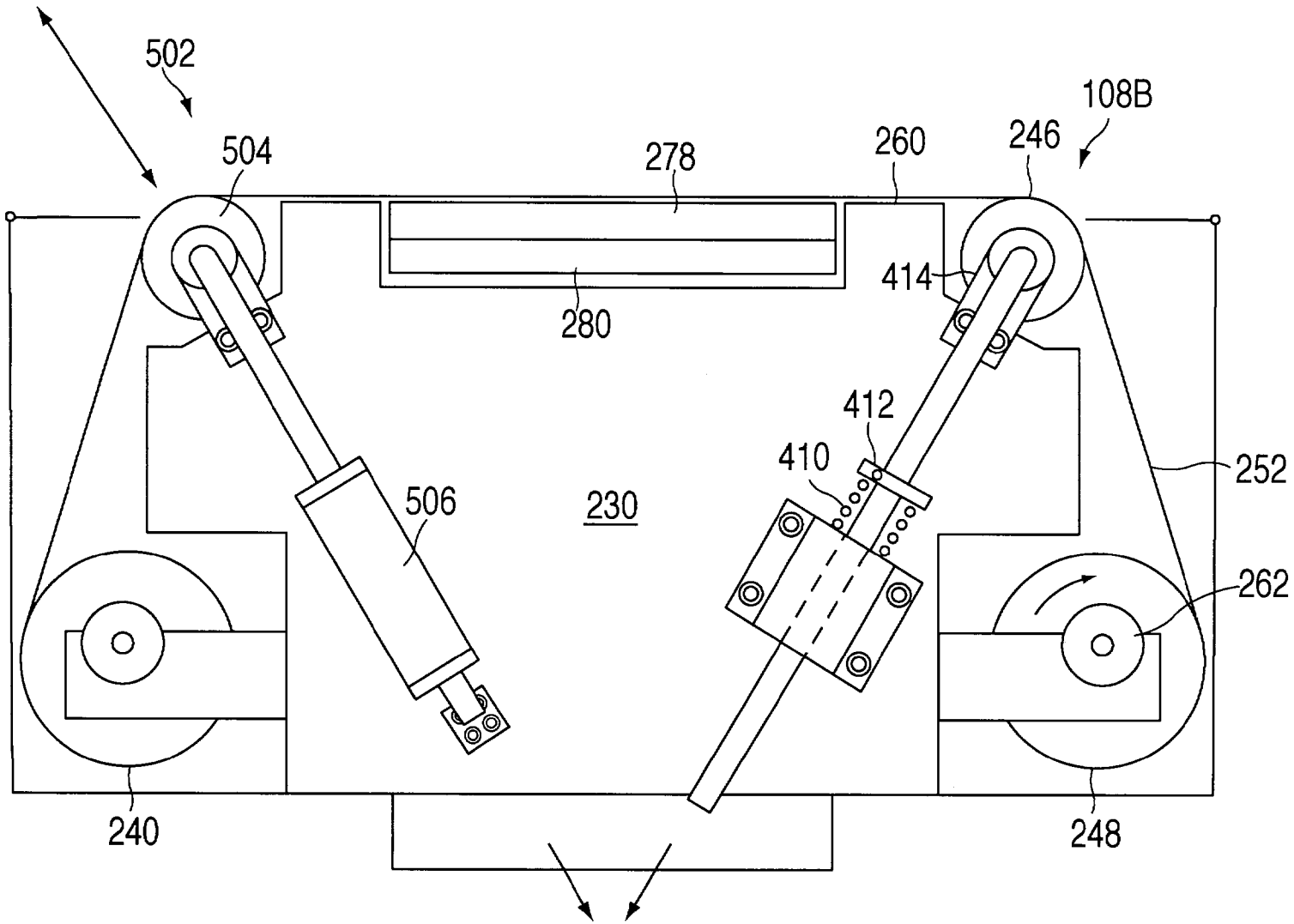
FIG. 5 is an elevation of another embodiment of a lift assembly.

FIG. 5 depicts another embodiment of a lift assembly 502. The lift assembly 502 is coupled to the platen 230 that is configured substantially the same as described in reference to FIGS. 2, 3 and 4 except where the indexing means 266 of FIG. 2 is incorporated into the lift assembly 502.

In one embodiment the lift assembly 502 includes a lift member 504 that is similar to the lift member 242 described in reference to FIG. 2. The lift member 504 is coupled to the actuator 506 that is coupled to the platen 230. The actuator 506 may be a pneumatic cylinder, a hydraulic cylinder, a lead screw, a solenoid or other linear motion device that can move the lift member 504 to an extended position. The actuator 506 may optionally be interfaced with a stroke limiting device 510 to control the distance the lift member 504 travels when the lift assembly 502 is extended. Such stroke limiting devices 510 are commonly offered as options on pneumatic cylinders, but may alternatively comprise threaded adjusters, shaft collars, or mechanical stops.

As the lift member 504 moves a predetermined distance, a corresponding predetermined length of polishing material 252 is unwound from the roll 240. As the lift member 504 returns to the retracted position, the polishing material 252 is advanced across the platen 230 by the tensioning device 262 that winds the polishing material onto the take-up roll 248.

Although the teachings of the present invention that have been shown and described in detail herein, those skilled in the art can readily devise other varied embodiments that still incorporate the teachings and do not depart from the scope and spirit of the invention.

What is claimed is:

1. A method for moving a web of polishing material comprising the steps of:

supporting a portion of the web of polishing material on a platen between a first member and a second member; and moving at least one of the first or the second members against an underside of the web to an extended position relative the platen that places the portion of the web in a spaced-apart relation with the platen.

2. The method of claim 1, wherein the step of moving at least one of the first or the second members comprises moving the first member and the second member.

3. The method of claim 1, wherein the step of moving further comprises unwinding a portion of the web.

4. The method of claim 1, wherein the step of moving further comprises at least partially extending the first member before extending the second member.

5. The method of claim 1 further comprising the step of winding the web to return any extended member to a retracted position.

6. The method of claim 1, wherein the step of moving pulls the web from a supply roll.

7. The method of claim 1, wherein the step of moving the first or the second member further comprises actuating a linear motion device.

8. The method of claim 7, wherein the linear motion device is a cylinder, solenoid or lead screw.

9. A method for moving a web of polishing material comprising the steps of:

polishing a first substrate on a portion of the web of polishing material supported on a platen; and mechanically pushing the web of polishing material away from the platen to place the portion of the web of polishing material and the platen in a spaced-apart relation after polishing the substrate.

10. The method of claim 9 further comprising advancing the mechanically spaced web.

11. The method of claim 10 further comprising:

mechanically lowering the mechanically spaced web of polishing material back into contact with the platen; and polishing a second substrate.

12. The method of claim 11, wherein the step of mechanioally pushing further comprises:

actuating a first roller guiding the web of polishing material onto an upper surface of the platen away from the platen.

13. The method of claim 12, wherein the step of mechanically pushing further comprises:

actuating a second roller disposed on a side of the platen opposite the first roller and having the web of polishing material disposed thereover away from the platen.

14. A method for moving a web of polishing material comprising the steps of:

mechanically pushing a portion of the web of polishing material away from a platen adapted to support the web of polishing mateilal during processing;

advancing the mechanically spaced portion of the web of polishing material across the platen;

returning the mechanically spaced portion of the web of polishing material into contact with the platen; and polishing a substrate on the platen.

15. The method of claim 14, wherein the step of mechanically pushing further comprises:

moving a roller having the web passing thereover and disposed between a supply roll having another portion of the web of polishing material wound thereon end the platen.

* * * * *

UNITED STATES PATENT AND TRADEMARK OFFICE

CERTIFICATE OF CORRECTION

PATENT NO. : 7,008,303 B2 
APPLICATION NO. : 10/408032
DATED : March 7, 2006
INVENTOR(S) : John M. White, Phillip R. Sommer and Sasson Somekh It is certified that error appears in the above-identified patent and that said Letters Patent is hereby corrected as shown below:

Column 7, Line 9: Change “taunt” to --taut--

Column 8, Line 58: After “force”, change “that” to --than--

Column 10, Claim 12, Lines 27-28: Change “mechanioally” to --mechanically--

Column 10, Claim 15, Line 51: Change “end” to --and--

Signed and Sealed this

Fourteenth Day of November, 2006

JON W. DUDAS
*Director of the United States Patent and Trademark Office*